United States Patent [19]

Pugh

[11] 4,421,144

[45] Dec. 20, 1983

[54] FILLING STOP IDENTIFICATION FOR LOOMS

[75] Inventor: Charles D. Pugh, Raleigh, N.C.

[73] Assignee: Burlington Industries, Inc., Greensboro, N.C.

[21] Appl. No.: 348,180

[22] Filed: Feb. 12, 1982

[51] Int. Cl.[3] ..... D03D 51/34

[52] U.S. Cl. ..... 139/370.2; 340/679; 340/825.08

[58] Field of Search ..... 139/336 R, 370.1, 370.2; 66/163; 340/33 R, 147 R, 259, 677, 679

[56] References Cited

U.S. PATENT DOCUMENTS

| | | | |
|---|---|---|---|
| 3,688,958 | 9/1972 | Rydborn | 139/370.2 |
| 3,728,680 | 4/1973 | Upshur | 340/679 |
| 3,840,869 | 10/1974 | Pugh | 340/259 |
| 3,863,241 | 1/1975 | Kimiyamaguchi et al. | 340/259 |
| 3,911,969 | 10/1975 | Rydborn | 139/370.1 |
| 4,178,590 | 12/1979 | Wiedmann | 340/677 |
| 4,365,654 | 12/1982 | Viniczay et al. | 139/370.2 |

OTHER PUBLICATIONS

Schematic of Eltex Stop Motion Device.

*Primary Examiner*—Henry Jaudon

*Attorney, Agent, or Firm*—Cushman, Darby & Cushman

[57] ABSTRACT

Apparatus and method for uniquely identifying which of a plurality of filling yarns used by a loom in a weaving process has broken and caused an automatic stop of the loom. The apparatus is particularly suited for fabrication by modifying known and commonly used loom stop motion systems.

25 Claims, 5 Drawing Figures

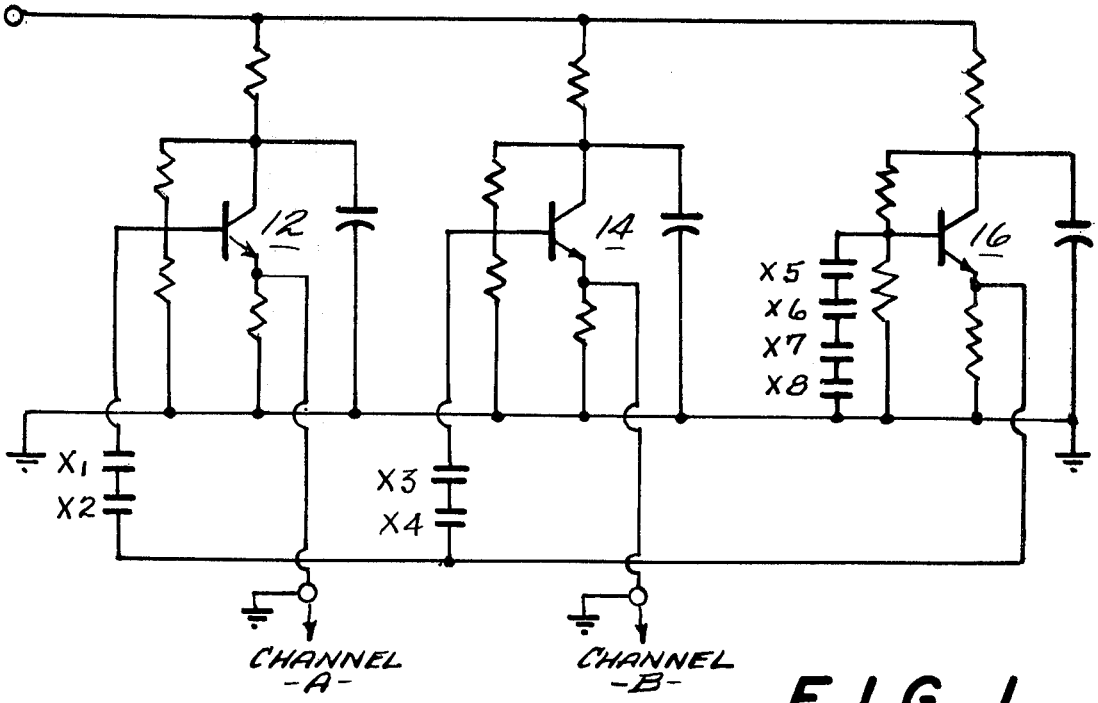
FIG. 1
(PRIOR ART)
FIG. 5
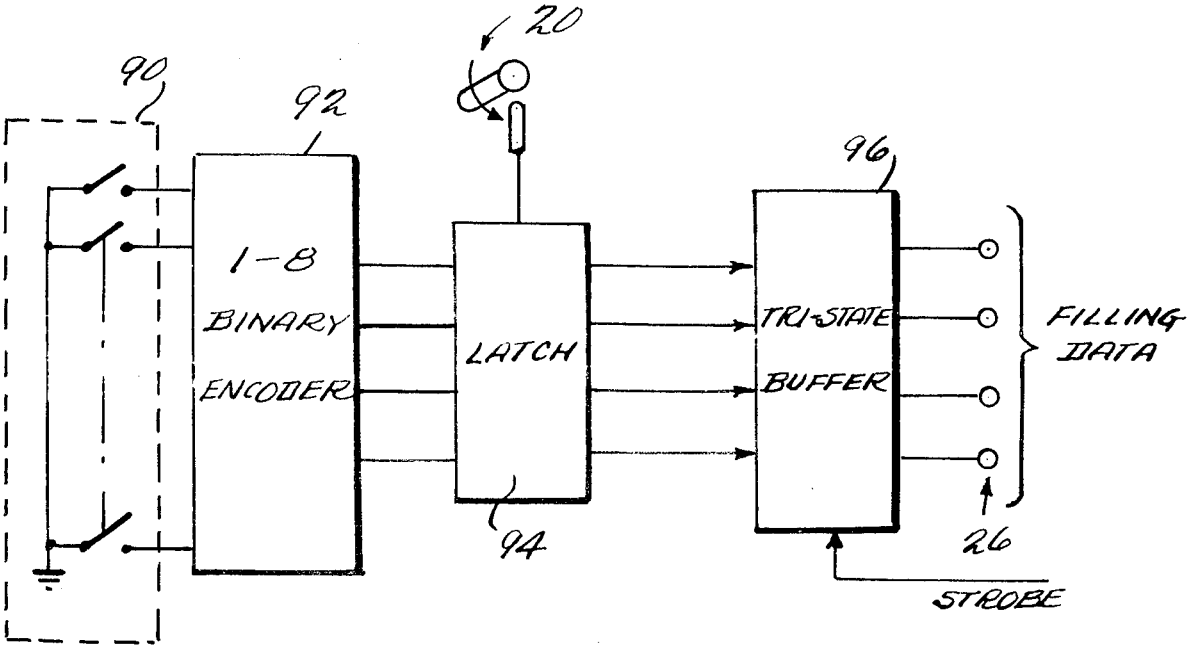

FILLING STOP IDENTIFICATION FOR LOOMS

The present invention relates to an improved loom fill yarn stop motion device. Specifically, it provides an arrangement for use in conjunction with an existing stop motion device to identify which one of a plurality of filling yarns has broken causing the loom to stop.

BACKGROUND OF THE INVENTION

Certain types of looms are capable of utilizing multiple filling yarns in a weaving process. The yarns are drawn from cones or packages mounted on a creel. These filling yarns are selected, one at a time, by a filling selector device and in a Dornier loom the selected filling yarn is drawn across the face of the cloth being woven by a rapier. Filling yarns, on occasion, do break and may not be fully pulled across the full width of the cloth by the rapier. In order to avoid missing or only partially inserted filling yarns in the finished cloth, a filling stop motion system, such as an Eltex stop motion, is positioned on the loom for detecting such fill yarn break failures and stops the operation of the rapier. Upon detection of a broken filling yarn, the stop motion system generates an electrical signal stopping the loom. The rapier is automatically returned to its starting point and will begin drawing yarn from the same selected yarn source as on the previous cycle during which the break occurred.

Although stop motion systems, such as the Eltex stop motion, employed throughout the industry operate quite effectively to detect a break in a filling yarn and stop the loom so that the broken yarn can be picked-up by the rapier again, the Eltex and other such systems fail to provide any data identifying which particular filling yarn broke. In order to determine which filling yarns are "problem yarns" or any reoccuring problems at the source of any such yarns, it is desirable to be able to keep track, over a period of time, of the frequency of breaks in particular yarns in order to identify faults so that corrective action may be taken.

Known loom data collection systems, such as disclosed in U.S. Pat. No. 3,728,680—Upshur, issued Apr. 17, 1973 and assigned to the assignee of this patent, do not provide the desired data.

The Upshur patent discloses a system for collecting data from looms, and particularly the reasons that looms have stopped. The Upshur system is concerned with the gathering of generalized information related to whether a loom was running or whether it stopped because of a break of a warp or filling yarn, and whether the break resulted from a mechanical failure or from a yarn running out. The system can be operated so that one or each loom or other device could be monitored with some predetermined frequency. Thus, use of the Upshur system provides information regarding filling stops, but one would know only that the machine stopped because of a broken filling yarn. Data indicating which particular filling yarn broke is not generated by the Upshur arrangement.

For looms operating in conjunction with an Eltex stop motion, or similar system, for stopping the loom when a filling yarn breaks it would be advantageous to compile data relating to the frequency of breakage of each filling yarn and to have this data stored in a permanent form for later use in identifying problem yarns or problems with particular positions in the yarn supply system.

In order to better understand the background of the present invention, a schematic of the electrical portions of the Eltex filling stop motion system is shown in FIG. 1. This system has a filling detector head including eight (8) eyelets. Each filling yarn is threaded so as to pass from its supply through one of the eyelets (one yarn associated with each eyelet) where it is held in a ready position so that when a yarn is engaged by the rapier, it will be drawn across through the fabric with the yarn being drawn through its eyelet. Associated with each of the eyelets are ceramic crystals $X_1 \ldots X_8$, each being positioned so as to vibrate and generate an electrical signal when yarn is drawn through its associated eyelet. The signals generated by crystals $X_1 \ldots X_8$ are amplified by transistor amplifiers 12, 14, 16. The amplified signals appear on output channels A and B of the filling detector head.

Output channels A and B from the filling detector head are coupled to a control box 18 (not shown in FIG. 1, but shown in FIGS. 2–3) and output signals thereon generate a loom stop signal for stopping the loom when a yarn breaks. A rapier switch box 20 (not shown in FIG. 1, but shown in FIGS. 2, 3 and 5) provides an "enable" signal to the control box indicating that the rapier is at a predetermined position in its transverse of the cloth being woven. Thus rapier switch box 20 creates a "sense window" restricting the time during which control box 18 makes a "decision" whether a filling yarn has broken by examining the channel A and B signals.

The combined action of the filling detector head and the control box produces loom stop output signals only when no filling yarn is being pulled through an eyelet by the rapier at the time defined by the sense window created by the enable signal from rapier switch box. However, it is not possible using such a conventional system to determine which particular filling yarn has broken.

Because stop motion systems, such as the Eltex stop motion, are so widely used throughout the industry, it is desirable to modify these existing units in order to provide the desired filling yarn data, rather than to add on to the loom yet another device for sensing the motion of each yarn. Therefore, there is a need for a relatively simple data generating arrangement providing the desired data that can be fabricated by modifying an existing stop motion system already in use on the loom. The present invention provides such a circuit.

For looms not having an Eltex stop motion or similar automatic loom shutdown device, the present invention can be implemented according to an alternate embodiment using discrete output filling sensors in place of a modified Eltex system.

SUMMARY OF THE INVENTION

Therefore, the present invention provides a loom monitor system which, operating in conjunction with a stop motion system, provides data related to the number of breaks of individual filling yarns. In the preferred exemplary embodiment of the loom monitor system, an Eltex stop motion is modified to perform both its originally intended function of stopping a loom stop, should a filling yarn break, and to further provide the desired data related to the frequency of breakage for each particular yarn.

As in the known Eltex Stop Motion system, there is a ceramic crystal, $X_1 \ldots X_8$, associated with each eyelet. That is where the similarity ends. According to this invention, the signals generated by crystals $X_1 \ldots X_8$ are coupled through a switch matrix (a diode switch matrix in the preferred exemplary embodiment) to a channel "A" amplifier and to a channel "B" amplifier.

The switch matrix is wired such that all of the crystals $X_1 \ldots X_8$ are coupled in parallel to the input of the channel "A" amplifier. Thus, a signal produced by any of the crystals causes an output from the channel "A" amplifier. In essence, the signals from crystals $X_1 \ldots X_8$ are all "added" onto channel "A". Thus, by looking at the channel "A" signal, one could only determine that a yarn is being drawn or that no yarn is being drawn. If a yarn is being drawn, the channel A signals contain no information as to which particular yarn is being drawn.

The switch matrix, in combination with polling signals coupled thereto, is provided to cause information as to which particular yarn is being drawn to appear in the "B" channel signal. The channel "B" signal, when decoded in accordance with the polling signals provided to the switch matrix can uniquely identify each separate yarn and, accordingly, the yarn that has broken.

The switch matrix and crystals $X_1 \ldots X_8$ are wired such that a signal from any particular crystal $X_1 \ldots X_8$ is coupled to the input of the channel "B" amplifier only when its associated switch element is closed (diode biased to be "on"). Thus the signals from crystals $X_1 \ldots X_8$ are "multiplexed" according to a predetermined sequence (provided by the polling signals onto channel "B" by the sequential closure of the switch elements one at a time.

Polling and decoding circuits provide polling signals to the switch matrix that sequentially close the switch elements one at a time while keeping track of which switch element is closed at a particular time.

As a yarn is being drawn across a fabric, the yarns are effectively sequentially polled by the polling signals applied to the switch elements. When a yarn is polled that happens to be in the process of being drawn through its crystal X, a channel B signal is generated. Control box 18, responsive to the channel A, channel B and rapier switch box 20 signals coupled thereto, generates a latch signal for latching data related to the polling signal applied to the switch matrix into a latch within the polling and decoding circuits. In the event of a yarn break, the loom stops normally. This invention has no way of knowing which yarn was not pulled through the sense eyelet causing the loom to stop; however, the first yarn code latched in latch 50 when the loom is restarted will be the correct yarn that caused the loom to stop previously. The computer will strobe fill data from Tri-State Buffer 52 only when the loom has been restarted from a filling stop.

In addition to the apparatus, above described, there is provided a method for monitoring a loom to provide data related to the breakage of filling yarns. The method includes the steps of generating, by a plurality of signal generating means associated one each with each of a plurality of yarns, signals indicating the motion or lack thereof for each one of the plurality of yarns;

multiplexing, according to a known predetermined sequence, the signals from each signal generating means and generating data indicative thereof;

correlating the data generated with the multiplexed signals to identify a particular yarn being drawn through the loom; and subsequent to restarting the loom following a stopping of loom due to a yarn break, reading data identifying the first yarn being drawn through the loom, thereby identifying the yarn that broke causing the loop to stop.

BRIEF DESCRIPTION OF THE DRAWINGS

The invention will be better understood from the following detailed description of the preferred exemplary embodiment and claims, read in conjunction with the drawings wherein:

FIG. 1 is a schematic diagram of an Eltex stop motion system filling detector head according to the prior art;

FIG. 5 is a schematic diagram of an alternate embodiment of the present invention using discrete output filling sensors.

DETAILED DESCRIPTION OF THE PREFERRED EXEMPLARY EMBODIMENT

Figure 2:
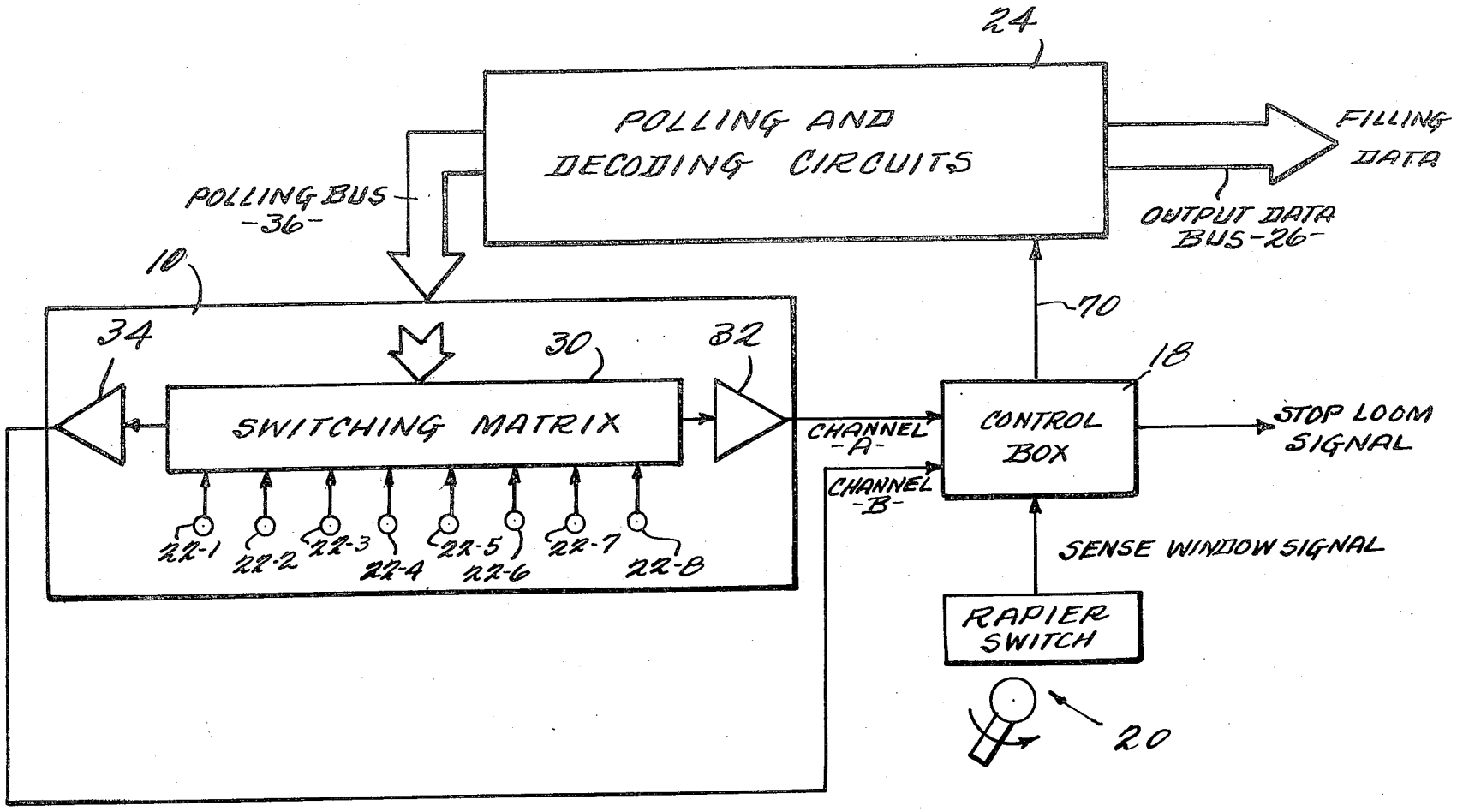
FIG. 2 is a block diagram of the present invention.

Referring now to FIG. 2 there is shown a general block diagram of the loom monitor according to the preferred exemplary embodiment of the present invention. As previously stated, the present invention is intended for use with a Dornier loom which is capable of utilizing multiple filling yarns in a weaving process. It should be understood, however, that this invention can be used equally as well with any device where multiple yarns or sources of supply are involved. These yarns are drawn from a conventional creel (not shown) and further description thereof is not deemed to be essential to present a full and complete description of the present invention. The yarns are selected, one at a time, by a filling selector device (not shown) that is part of the Dornier loom. A rapier (not shown) on the loom "grabs" a yarn selected by the filling selector device and traverses across the width of the loom pulling the selected filling yarn across the face of the cloth being woven inserting it into a woven fabric. These operating elements and characteristics of looms are also conventional and further description thereof is not deemed to be essential to present a full and complete description of the present invention.

The loom monitor includes a filling detector head 10 having eight (8) eyelets 22-1 . . . 22-8, each for receiving a single filling yarn threaded from the creel, through an eyelet of the filling detector head and then to the filling selector device of the loom. Filling detector head 10 includes a switch matrix 30, a channel "A" amplifier 32 and a channel "B" amplifier 34. Switch matrix 30 is operated by polling signals provided thereto on a polling buss 36.

The polling signals for oprating switch matrix 30 are generated by polling and decoding circuits 24 which also generates data related to the polling signals ultimately delivered to a data store (not shown) via an output data buss 26.

The channel "A" and "B" outputs of filling detector head 10 are coupled to a control box 18 that is well known and forms a part of the prior art Eltex stop motion, previously referred to. However control box 18 is modified to provide a latching signal on a signal line 70 for use in latching data generated by polling and decoding circuits 24. This modification is accomplished by merely bringing out a signal line from the channel B section of the Eltex device. A rapier switch 20 provides an enable signal to control box 18. This enable signal defines a "sense window" indicating that the rapier is at a predetermined position in its traverse of the loom and fabric being woven. Control box 18 makes its "decisions" as to whether a yarn has broken during this sense window. The operation of the filling monitor, as shown in FIG. 2 will now be discussed.

Figures 3, 4:
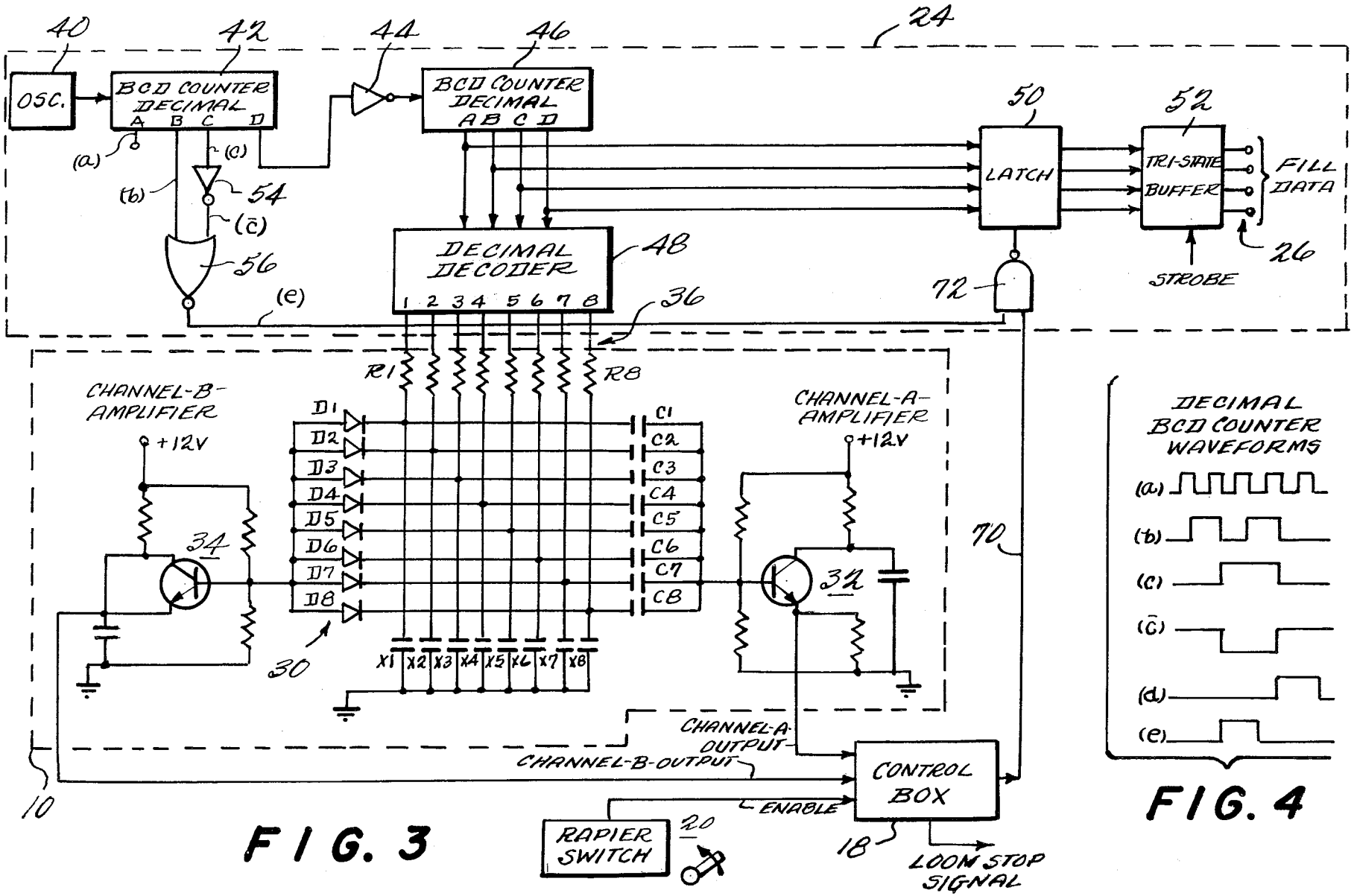
FIG. 3 is a detailed schematic diagram of the preferred exemplary embodiment of the present invention.
FIG. 4 is a graphical representation of waveforms at various nodes of the circuit shown in FIG. 3 and illustrating the generating of a two (2) phase clock signal for synchronizing polling signals with data indicative thereof.

The filling yarns, each from its own supply cone, are threaded one each through eyelets 22-1 . . . 22-8 of the filling detector head 10. Associated with each eyelet 22 is a ceramic crystal, $X_1 \ldots X_8$, corresponding to eyelets 22-1 . . . 22-8 respectively, which provides an electrical signal when a yarn is moving through its respective eyelet. The motion of the yarn vibrates the ceramic crystal generating the electrical signal. These electrical signals are coupled to switch matrix 30 providing signals to channel A and Channel B amplifiers 32 and 34, respectively. The signals provided to the channel A and B amplifiers are different from one another. In essence, the signal coupled to channel A amplifier 32 represents the addition of the outputs of crystals $X_1 \ldots X_8$. In essence, the output of the crystals are wired in parallel to the input of channel A amplifier 32. However, crystals, $X_1 \ldots X_8$ are coupled through switch matrix 30 to the input of channel B amplifier 34 in such a fashion that a signal from a particular crystal will be coupled to the input of the channel B amplifier only when an associated switch element, as shown in FIG. 3, is closed to provide a completed circuit path from the crystal to the input of channel B amplifier 34. Thus, by controlling switch matrix 30, the particular crystal X that is supplying a signal to channel B amplifier 34 can be determined. The individual switch elements of switch matrix 30 are closed and opened in response to polling signals coupled to the switch matrix via polling buss 36. Thus, given a predetermined sequence for switching the elements of switch matrix 30, the information on the channel B output from filling detector head 10 can uniquely identify the crystal supplying a signal to the channel B amplifier. Of course, such information is only meaningful when interpreted in view of the polling signals supplied to switch matrix 30 via polling buss 36.

The channel A and B signals are coupled to the input of control box 18. When a signal appears on the channel B output of filling detector 10, control box 18 provides a latching signal on signal line 70 coupled to polling and decoding circuits 24. When polling and decoding circuits 24 provides a polling signal on polling buss 36 for closing a particular switch element, it generates data uniquely identifying the switch element being closed. This data is coupled to a latch within the polling and decoding circuits 24. The latch signal generated by control box 18 and coupled to polling and decoding circuits 24, in essence, latches or fixes this data into a latch. Thus, the data so latched uniquely identify the source of the signal on the channel B output of filling detector head 10. After a loom has been restarted from a filling stop the first code latched into latch 50 will be the yarn that caused the filling stop. This code will be transferred to output data buss 26. Data is strobed onto output data buss 26 one time after loom start-up after a filling stop. This one time is the first filling yarn detected by control box 18 after start up. This data is coupled to a data store (not shown) which can be a computer or other such device for tallying the data and presenting it to an operator in easily useable form such as a printed table or the like. A more complete schematic diagram of the loom monitor is shown in FIG. 3.

Referring now to FIG, 3, details of filling detector head 10 and polling and decoding circuits 24 are shown. Polling and decoding circuits 24 include an oscillator 40, a BCD decimal counter 42, an inverter 44, a BCD decimal counter 46, a decimal decoder 48, a latch 50, an inverter 54, a NOR gate 56, a NAND gate 72, and a tri-state buffer 52.

The individual switch elements of switch matrix 30 are diodes D1 . . . D8. Polling buss 36 includes 8 outputs of decimal decoder 48, each coupled to an associated diode D via a single resistor R1 . . . R8. In order to poll a particular diode, a signal appears at the appropriate output of decimal decoder 48. This signal, coupled through its associated resistor, provides a "low" signal to the diode. This low signal causes the diode to become forward biased and, therefore, placed in a short circuit condition. This short circuit condition corresponds to the closing of a switch element. In the absence of a polling signal on a particular line, an output of decimal decoder 48 is "high" thereby maintaining its associated diode reverse bias and open. Thus, when a particular diode switch element is polled, by the presentation of a low signal at the cathode thereof, any signals generated by its associated crystal X are coupled through the diode through the input of channel B amplifier 34.

Each of the outputs of crystals $X_1 \ldots X_8$ are also coupled through a capacitor C1 . . . C8, respectively to the input of channel A amplifier 32. Capacitors C1 . . . C8 are coupled in parallel at their respective terminals coupled to the input of channel A amplifier 32 so that a signal generated by any of crystals $X_1 \ldots X_8$ will be coupled to the input of channel A amplifier 32. Thus, the presence of a signal at the channel A output of filling detector 10 indicates that one of the yarns passing through filling detector head 10 is in motion and generating a signal. However, it cannot be determined from the channel A output which of the yarn is in motion.

Polling and decoding circuits 24 generate in sequence "low" signals at the eight outputs of decimal decoder 48 according to a predetermined sequence. This sequence is repeated continuously. The sequence is generated by the action of oscillator 40 and counters 42 and 46. The output of oscillator 40 is coupled to BCD decimal counter 42. The lowest order bit output (D) of counter 42 is coupled through inverter 44 to counter 46. Counter 46 provides A, B, C and D outputs delivering a binary coded signal which merely counts from 0 to 9 and then returns to 0 again. Thus, the four outputs A, B, C and D of counter 46 identify in binary code a number from 0 to 9. This binary code is coupled to latch 50 and to decimal decoder 48. Decimal decoder 48 decodes the binary code output of decimal counter 46 and places a low signal on one of eight output lines 1–8 thereof called for by the binary code coupled to its input lines. At the same time that decimal decoder 48 is decoding the binary code generated by decimal counter 46, the binary code is presented to the input of latch 50 where it remains in binary form. At an appropriate time, this binary data presented at the input of latch 50 can be "latched" and held therein for transfer to tri-state buffer 52.

The purpose of inverters 44 and 54 and NOR gate 56 is to provide a two-phase clock with one phase being represented by the output of inverter 44 and the other phase thereof being represented by the output of NOR gate 56. This two-phase clock permits the binary data generated by BCD decimal counter 46 to be correlated with latch signal generated by control box 18 and provided via line 70.

FIG. 4 sets forth waveforms which further explain how the two-phase clock is generated. Oscillator 40 provides input to BCD Decimal Counter 42. BCD Decimal Counter 42 has a single input with four coded outputs A, B, C and D. Waveform (a) represents the A output of counter 42; waveform (b) represents the B output of counter 42; waveform (c) represents the C output of counter 42; waveform (d) represents the D output of counter 42. Counter 42 output "C" is inverted by inverter 54 to become waveform (C). Waveform (C) and counter 42 output "B" are logically NORED by NOR gate 56 to form the two-phase clock waveform a portion of which is shown in (e).

Of course other circuit arrangements could be utilized to generate a two-phase clock. For example, a sine wave generator output could be coupled to two Schmitt trigger levels set to trigger at predetermined points on the sine waveform to create digital pulses having a predetermined phase relationship. As a second example, a square wave generator could be capacitatively coupled to a diode network for generating clock signals on both the positive and negative swings of the square wave. Any two-phase clock could be used in this invention as long as the clock frequency and phases are within the limits required by the rest of the circuitry of the invention. The frequency must be such that BCD counter 46 can bounce from 0 through 9 within the enable window time defined by the action of rapier switch 20.

The purpose of the two phase clocks is to allow electrical settling and stabilizing of the signals from counter 46 to latch 50 and the output signal 70 from counter box 18. After the BCD code from counter 46 is steady and signal 70 is steady, then waveform (e) from NOR-gate 56 latches the BCD code into batch 50.

For a given four bit binary code generated by counter 46, and transferred to the input of latch 50, decimal decoder 48 provides a low signal on one of its eight outputs which is coupled to the switch matrix 30 via polling buss 36. This signal in essence closes a switch element uniquely identifying a particular crystal X. If a signal is present on channel B as a result of a yarn being pulled through that particular crystal, a latch signal generated on line 70 is NAND gated with the clock signal from NOR gate 56 by a NAND gate 72. The output of NAND gate 72 latches the four bit binary code from counter 46 over to tri-state buffer 52. For those particular diode elements polled that are associated with yarns not being drawn, no signal will be generated on line 70 and the four bit code generated by counter 46 will not be so latched. Thus, latch 50 will only transfer data corresponding to diode and crystals associated with the particular yarn in motion. Therefore, the data latched to tri-state buffer 52 will always indicate the yarn then in motion. Later, when the loom stops in accordance with a loom stop signal and then restarts, tri-state buffer 52 is strobed. The data transferred out of tri-state buffer 52 on output data buss 26 therefore identifies the immediately preceding yarn being drawn through the loom by the rapier.

Referring now to FIG. 5 there is shown a schematic diagram of an alternate embodiment of the present invention. In this embodiment, an Eltex filling detector head is not modified. Rather, discrete output filling sensors are used. The sensors couple signals represented schematically by switches 90. The signals from switches 90 are coupled to a one out of eight binary encoder 92. Data provided by the outputs of binary encoder 92 are coupled to a latch 94. The latch signal for latch 94 is provided by the sense window signal provided by rapier switch 20. Data latched by latch 94 is transferred to a tri-state buffer 96 corresponding to buffer 52 shown in FIG. 3. The oscillator 40, BCD counter decimal 42, inverter 54, NOR gate 56, BCD decimal counter 46 and decimal decoder 48 are the same as shown in FIG. 3 and therefore not depicted in FIG. 4.

Therefore, there has been provided a loom monitor for use with a loom drawing a plurality of filling yarns one at a time through a fabric being woven. The monitor provides data indicating the number of breaks for each of the filling yarns.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. A loom monitor system for identifying which one of a plurality of filling yarns has broken, comprising:

a plurality of sensing means, each associated with one of said plurality of filling yarns, each for generating a sensing signal indicative of movement of its associated yarn;

polling means for sequentially polling the plurality of sensing means and generating data indicative of the sensing means being polled;

signal storage means responsive to said sensing signal generated by a polled sensing means for temporarily storing the data generated by the polling means, thereby identifying a yarn currently being drawn; and data transfer means responsive to said polling means and to the loom being restarted after a filling yarn break causing a loom stop for transferring the data temporarily stored and indicative of the first yarn being drawn through the loom after restart, thereby indentifying the yarn that broke.

2. A loom monitor according to claim 1 wherein each sensing means comprises a ceramic crystal.

3. A loom monitor according to claim 1 wherein the polling means comprises:

means for (a) sequentially generating polling signals on lines of a polling buss each line being associated with one sensing means and (b) generating data indicative of the particular line of the buss on which a signal is being generated;

a switch matrix having individual switch elements coupled one each to the sensing means, a polling signal on its respective line of the polling buss, a polling signal at a line causing its associated switch element to close, thereby polling its associated sensing means.

4. A loom monitor according to claim 3 wherein the switch matrix comprises a plurality of diodes arranged to be reverse biased in the absence of a polling signal applied thereto and forward biased in the presence of a polling signal applied thereto.

5. A loom monitor according to claim 1 wherein the means for temporarily storing comprises a latch.

6. A loom monitor according to claim 5 wherein the data transfer means comprises a strobed tri-state buffer a strobe signal being coupled thereto after a loom restart following a loom stop due a yarn break.

7. A loom monitor system for providing data identifying a particular filling yarn that has broken during weaving wherein a plurality of filling yarns are drawn, one at a time by a rapier from a multi-yarn supply, comprising:

a filling detector head through which each of the filling yarns is threaded and moved when that yarn is drawn by the rapier including a sensor associated with each yarn and including a first output providing a signal whenever any of the yarns are being drawn and a second output providing a signal only when a sensor associated with the yarn being drawn is polled;

a demultiplexer circuit for providing (a) polling signals to the filling detector head and (b) data identifying the sensor currently being polled; and including an actuable temporary storage for temporarily storing the data and means, responsive to a restarting of the loom after a stopping of the loom due to a yarn break, for transferring data previously stored;

a rapier switch for generating a signal indicative of the rapier being at a predetermined position in its traverse of the loom;

a control box, coupled to the first and second outputs of the filling detector head and to the rapier switch for generating a store signal indicative of the yarn being drawn through the filling detector head simultaneously with the application of a polling signal being applied to the filling detector head for polling the sensor associated with the yarn being drawn, the store signal being coupled to the demultiplexer circuit for actuating the temporary store therein, the means for storing, upon being actuated by the store signal identifying the yarn being drawn through the filling detector head and for generating a loom stop signal whenever no filling yarn is being drawn through the filling detector head, whereby when the loom is stopped, in response to a loom stop signal and then restarted, the stored data in the means for storing within the demultiplexer identifies the yarn that is first being drawn through the fabric after the restart thus identifying the yarn that broke causing the stop.

8. A loom monitor according to claim 7 wherein the filling detector head sensors comprise ceramic crystals.

9. A loom monitor according to claim 7 wherein the filling detector head comprises a first channel amplifier providing the first channel output, a second channel amplifier providing the second channel output, a switch matrix having elements coupled to each of the sensors and to polling buss for receiving the polling signals from the demultiplexer circuit.

10. A loom monitor according to claim 9 wherein the switch matrix comprises an array of diodes arranged to be reverse biased in the absence of a polling signal coupled thereto and forward biased in the presence of a polling signal coupled thereto.

11. A loom monitor according to claim 7 wherein the temporary store is a latch.

12. A loom monitor according to claim 11 wherein the means for transferring is a strobed tri-state buffer.

13. A method for identifying a particular one of a plurality of yarns that has broken during weaving process on a loom, comprising the steps of:

generating by a plurality of signal generating means, associated one each with each of a plurality of yarns, signals indicating the motion or lack thereof, of each of the yarns;

multiplexing according to a known predetermined sequence, the signals from each signal generating means and generating data indicative thereof;

correlating the data generated with the multiplexed signals to identify a particular yarn being drawn through the loom; and subsequent to restarting the loom following a stopping of loom due to a yarn break, reading data identifying the first yarn being drawn through the loom, thereby identifying the yarn that broke causing the loom to stop.

14. A method according to claim 13 further including the step of generating a sense window corresponding to a predetermined position of a rapier of the loom drawing a yarn therethrough and wherein the step of transferring data occurs only if the yarn is broken when the rapier is at the predetermined position.

15. An apparatus for identifying a particular one of a plurality of yarns that has broken during weaving process on a loom, comprising means for generating by a plurality of signal generating means, associated one each with each of a plurality of yarns, signals indicating the motion or lack thereof, of each of the yarns;

means for multiplexing according to a known predetermined sequence, the signals from each signal generating means and generating data indicative thereof;

means for correlating the data generated with the multiplexed signals to identify a particular yarn being drawn through the loom; and means, responsive to a loom restart after a loom stop due to a yarn breakage, for dumping data indicative of the first yarn to be drawn through the loom to a data store thereby uniquely identifying the broken yarn.

16. An apparatus according to claim 15 wherein the means for generating comprises a plurality of ceramic crystals.

17. An apparatus according to claim 15 wherein the means for multiplexing comprises a switch matrix having a switch element coupled to each of the means for generating and means for providing polling signals to the switch matrix to actuate each of the switch elements according to a predetermined sequence.

18. An apparatus according to claim 17 wherein the means for providing polling signals generates data related to the polling signals.

19. Apparatus according to claim 18 wherein the means for correlating comprises a latch for latching the data generated by the means for providing polling signals, the operation of the latch being synchronized with the polling signals to establish latched data uniquely identifying a signal from a particular signal generating means, thereby uniquely identifying a particular yarn.

20. In a loom for weaving a fabric with one yarn at a time selected from a plurality of yarns and including an automatic stop motion device for stopping the loom when a yarn being woven breaks, the improvement comprising means for identifying which particular yarn of the plurality of yarns broke.

21. An improvement according to claim 20 wherein the means for identifying comprises:

means for generating by a plurality of signal generating means, associated one each with each of a plurality of yarns, signals indicating the motion or lack thereof, of each of the yarns;

means for multiplexing according to a known predetermined sequence, the signals from each signal generating means and generating data indicative thereof;

means for correlating the data generated with the multiplexed signals to identify a particular yarn being drawn through the loom; and means, responsive to a yarn breakage loom stop and loom restart for dumping data indicative of the first yarn to be drawn through the loom to a data store thereby uniquely identifying the broken yarn.

22. An improvement according to claim 20 wherein the means for generating comprises a plurality of ceramic crystals.

23. An improvement according to claim 21 wherein the means for multiplexing comprises a switch matrix having a switch element coupled to each of the means for generating and means for providing polling signals to the switch matrix to actuate each of the switch elements according to a predetermined sequence.

24. An improvement according to claim 23 wherein the means for providing polling signals generates data related to the polling signals.

25. An improvement according to claim 24 wherein the means for correlating means for latching the data generated by the means for providing polling signals, the operation of the latch being synchronized with the polling signals to establish latched data uniquely identifying a signal from a particular signal generating means, thereby uniquely identifying a particular yarn.

* * * * *